United States Patent [19]

Miyazawa et al.

[11] 4,301,238

[45] Nov. 17, 1981

[54] METHOD FOR THE MANUFACTURE OF SILVER HALIDE PHOTOGRAPHIC MATERIAL

[75] Inventors: Sadayuki Miyazawa; Takashi Kadowaki; Isao Yamamoto, all of Odawara, Japan

[73] Assignee: Konishiroku Photo Industry Co., Ltd., Tokyo, Japan

[21] Appl. No.: 170,942

[22] Filed: Jul. 21, 1980

[30] Foreign Application Priority Data

Jul. 23, 1979 [JP] Japan ..... 54-93536

[51] Int. Cl.[3] ..... G03C 1/76

[52] U.S. Cl. ..... 430/495; 430/564; 430/642; 430/935; 427/377; 427/378

[58] Field of Search ..... 430/642, 935, 564, 569, 430/495; 427/377, 378

[56] References Cited

U.S. PATENT DOCUMENTS

| | | | |
|---|---|---|---|
| 2,269,169 | 1/1942 | Van Derhoef et al. | 430/935 |
| 2,620,285 | 12/1952 | Rose | 430/935 |
| 3,936,306 | 2/1976 | Minoda et al. | 427/377 |
| 4,051,278 | 9/1977 | Democh | 430/935 |

*Primary Examiner*—J. Travis Brown

*Attorney, Agent, or Firm*—Bierman & Bierman

[57] ABSTRACT

An improved method of producing a silver halide photographic material having a layer containing gelatin coated on a support is disclosed. The coated layer is dried so that its surface temperature during the falling rate drying period is more than 5° C. over the melting point of the layer during drying and the jelly strength of the gelatin is at least 200 g according to the PAGI method.

4 Claims, 1 Drawing Figure

METHOD FOR THE MANUFACTURE OF SILVER HALIDE PHOTOGRAPHIC MATERIAL

This Application claims the priority of Japanese Pat. No. 93536/1979, filed July 23, 1979.

The present invention relates to the manufacture of a silver halide photographic material having a photographic layer improved in the physical characteristics thereof, and more particularly to the manufacture of a silver halide photographic material of which the photographic layer containing gelatin as a binder is improved such that the layer is free of becoming matt resulted from the reticulation phenomenon caused by the developing process, and is highly excellent in the hardening characteristics.

In general, silver halide photographic materials comprise constructive layers, such as silver halide emulsion layers protective layer, interlayer, filter layer, ultra violet absorbing layer, antihalation layer, subbing layer, backing layer containing gelatin as binder or protective colloid. Above all, the outermost layer is in the visually significant position, because the image is observed through the layer after development process, which layer effects an influence upon the commercial value of the material. These photographic layers are formed on a support in such a manner that photographic layer coating composition are, singly or multiply, simultaneously coated in such a process as dipping process, air-knife coating process, slide hopper type extruding process. The coated layers are then cooled to be set, and thereafter subjected to humidification until they reach the level of moisture equilibrium by drying in dried air stream. The thus manufactured photographic material is usually exposed to light and developed. We have often experienced that during the development, the surface of the material becomes mat due to the reticulation caused by excessive swelling of the gelatin-containing layers, resulting in the loss of its gloss, thus reducing the commercial value of the material.

The major factors affecting the gloss of the surface of such photographic layer are considered to be the nature of the gelatin used, the degree of setting (or gelation) of the layer by cooling, and the drying condition. Low speed coating, or inappropriate and uneconomical drying conditions have heretofore been adopted, merely considering that the sufficient cooling for setting and the most gentle possible drying of the layers are needed to obtain an excellent gloss on the surface.

However, as the improvement in the production capacity in recent years requires the increase of the coating speed, high efficiency has been considered essential for both the setting and drying processes. Since the coating and drying in the manufacture of photographic materials are usually performed in continuous process, in order to increase the coating speed there is need to proportionally lengthen both the distances of the cooling zone and drying zone, resulting in giving disadvantage to the equipment and economy in operation.

Some attempts have been made to meet the requirement of higher speed coating with the restriction of the equipment in the process, and particularly some practices in art have hitherto been suggested for the purpose of improving the gloss of coated layers. Among other things, exertions have been concentrated upon the physical characteristics of the outermost layer, trying to select a gelatin having as much high physical characteristics and high orientation as possible to overcome the factors having a disadvantageous effect on the gloss due to the restriction of the coating equipment as well as the presence of the silver halide or dispersed couplers being essential for silver halide photographic materials as, for example, Japanese Patents Laid-Open-to-Public Publication Nos. 53-9518 and 53-13413 describe the use of lime-treated gelatin having jelly strength of more than 300 on outermost layer. Selecting gelatin is certainly one of the effective ways, i.e., the use of a gelatin of high stiffness obtained when the layer is gelled by cooling, i.e., of high jelly strength, and particularly applying it to the outermost layer results in outstandingly improved gloss on the layer surface, contributing to the improvement in the manufacturing quality of the product.

Meanwhile, selection for the material to be employed in photographic materials is naturally limited, and further improvements in physical characteristics of gelatin nearly reaching the limit in the market scale, and therefore, still further improvements may no longer be made for such a material as gelatin. On the other hand, present day need of rapid processing at a high temperature requires increasing severity of processing conditions. As to the coating and drying conditions there have been two ideas; one is for placing emphasis on constant rate drying period, and the other on falling rate drying period, requirements for them obtained after trial-and-error experiences, wherein the constant rate drying means that process of the water content of the coated layer or layers reducing in almost proportion to the lapse of drying time under the air conditions of constant temperature with constant humidity in the course of drying the coated layer on a support, while the falling rate drying means the process in which the falling rate of the water content is lowered following the process of the constant rate of drying; that is, the drying process usually progresses in such a manner as coating, cooling for gelation, constant rate drying, falling rate drying, and humidification in the order described herein. In this case, the surface temperature of the layer in the course of constant rate drying is nearly closed to the wet-bulb temperature, and, when entered the falling rate drying, begin to rise and finally reaches the dry-bulb temperature. At this time, the drying process comes to an end.

It had been found in our groping in the past that a most sufficient possible cooling for gelation results in providing the photographic material's surface with an excellent gloss. This is a common idea with that of selecting what have higher stiffness from gelatins, which is advantageously adopted for the reason it does not affect the orientation of gelatin molecules. However, the coating speed has been sacrificed to some extent on the experienced grounds that a slowest possible drying would give good results in the subsequent drying process. And it was believed that, noticing the course of contraction of gelatin in the falling rate drying period, keeping the drying condition in the falling rate drying period at lower temperature would give satisfactory results. So to speak, it is status quo of the manufacture of silver halide photographic materials that the groping in the dark is being made for the drying conditions in accordance with such ambiguous consideration under the pressure of necessity for responding to the growing severity of requirements for use, quality, and the need for making the manufacturing process highly efficient.

It is an object of the present invention to provide the method for the manufacture of a silver halide photographic material having layers of excellent physical characteristics. It is another object of this invention to provide the method for the manufacture of a silver halide photographic material which is improved in the gloss of the surface thereof.

It is a further object of this invention to provide the method for the manufacture of a silver halide photographic light-sensitive material which is improved in the hardness of the layers thereof.

It is a still further object of this invention to provide the method for the manufacture of a silver halide photographic material which is improved in the drying efficiency thereof.

According to the present invention the coated layer is dryed so that the surface temperature of the layer is substantially lower in the constant rate drying period, and is higher in the falling rate drying period than the temperature of 5° C. plus the melting point of the layer at a time of the passage of this process.

In the present invention, jelly strength is taken as unit in stating the stiffness of gelatin, which is specified in PAGI METHOD described in Page 4 of the "Testing Method for Photographic Gelatin 3rd Ed." (issued in 1977 by Commission on Testing Method for Photographic Gelatin). Jelly strength is expressed in terms of gram number required for pressing down 4 mm the surface of a jelly by applying a load to a metal cylinder of about 13 mm in diameter which is placed under a given condition on the surface of the $6\frac{2}{3}$% gelatin jelly prepared in a specified jelly cup.

The higher the jelly strength of gelatin the better the orientation of gelatin molecules become. Accordingly, it is also experimentally proved that the higher strength have a good effect on the surface gloss of the gelatin layer itself. However, the gelatin with the jelly strength of less than 200 g is not applicable to this invention. The gelatin with the jelly strength of less than 200 g does not necessarily provide satisfactory results even if the surface temperature of the outermost layer is lower in the constant rate drying period than that of the melting point at the time of being present plus 5° C., and even in the falling rate drying period such gelatin less contributes to the improvement in the hardening characteristics in raising the surface temperature of the outermost layer, thus being unable to accomplish the objects of the present invention. In this invention, therefore, gelatin having the jelly strength of more than 200 g must be applied to at least the outermost layer of the layers coated on a support. Meanwhile, the constant rate drying and falling rate drying in this invention are to be applied to one layer or two or more layers simultaneously coated, provided, however, that they may also be applied to the layers, each of which layers was separately coated in different time if the subsequent layer is coated on the preceding one prior to entering the drying process.

As a result of our experiments, the surface temperature of the outermost layer in the drying process is not necessarily coincident with but sometimes slightly higher than the wet-bulb temperature of the drying air in the constant rate drying period, being subjected to the influence of the heat transmission factor from the back of the support at the time of drying, and in addition, since even the constant rate drying is accompanied by a slight falling rate drying effect, the difference between the wet-bulb temperature and the surface temperature was found slightly increasing. Afterward, the surface temperature and the dry-bulb temperature begin to be close rapidly to each other, and then become coincident at the end of the drying. And the point at which the surface temperature and the dry-bulb temperature begin to be close rapidly is the turning point the falling rate drying from the constant rate drying. It is observed that the gelatin concentration of being dryed layer reaches the 16–17% is regarded as the turning point. And this concentration is constant, and not affected even when the gelatin concentration of the coating liquid or the drying air temperature is changed. It was found that the surface temperature in the constant rate drying period in which the gelatin concentration of the coating varies up to 16–17% exerts a significant influence upon the gloss produced after the developing of the product, but the surface temperature being higher than the melting points of the gelatin layer while in the course of the drying process is not necessarily considered to cause the loss of the gloss, and the surface temperature to cause reticulation, contrary to the inventor's expectation, is at 5° C. higher than the melting points of the layer while in the course of drying. Preferable surface temperature in the constant rate drying period is ±3° C. of the melting point. Further, it was also found that in the subsequent falling rate drying period, even when the surface temperature is largely raised beyond the melting point of the layer even up to 80° C. higher than the melting point while in the drying, such reticulation phenomenon was not found at all, and rather, raising the surface temperature beyond the melting point exerted an outstandingly excellent effects on the hardening of the coated layers. In addition, the effect produced when the surface temperature was raised was found well adapted to gelatin having some high degree of physical characteristics, and effectively applicable to gelatin with the jelly strength of more than 200 g. A preferable temperature of the surface is 10° C. to 70° C. higher than the melting point.

Gelatin with the jelly strength of more than 200 g may be found in the Ossein Gelatin of cow bones, prepared by treating with lime, which is extensively used in the field of photography. Gelatin of relatively high physical characteristics may be extracted by selecting extracting conditions after the lime-steeping treatment. Besides, similar grade of gelatin may also be obtained advantageously from the so-called acid-treated gelatin having relatively high conductivity, extracted by acid treatment from, e.g., the hide of pig. Gelatin having jelly strength of up to about 400, which is usable for the present invention, is supplied on market.

In the present invention, the foregoing description that the drying condition of the layer does not imply that all such conditions must be observed severely in each of the constant and falling rate drying periods but implies that partial divergence from such conditions may be allowed unless it reduces the effect of the present invention.

In the practice of the present invention, the surface temperature may be measured by a known method, such as, e.g., an infrared surface thermometer. The drying condition, e.g., the temperature of the drying air and humidity should be controlled so that the measured surface temperature falls into the range of the conditions of this invention. The outermost layer in this invention includes the outermost layer of a finished product and an intermediate product in the course of the manufacture, and also includes the layer of either a finished product or an intermediate product if such product has single layer alone on one side thereof. The thickness of the outermost layer when dried should be within the range of 0.2–5μ, preferably, from 0.5μ to 3μ. The outermost layer of an intermediate product may constitute a layer not containing silver halide emulsion which is usually called interlayer when it becomes a finished product. The term "intermediate product" means a composition which requires one or more further layers to be coated thereon in order to become a finished product, such as, for example, an integral multilayer photographic color material.

"The melting point of the outermost layer when present in the course of drying" means the melting point of the composition material having the same composition as the outermost layer coating liquid from which the solvent is evaporated until it reaches the same gelatin concentration as the average gelatin concentration of the layer when present in the drying process, measured in accordance with the method of measuring melting point specified such as in PAGI method. The term "the layer" means the layer being the subject to the constant rate drying and the reduced rate drying. The reason that the effect of this invention is accomplished by controlling the surface temperature based on the melting point of the top layer in this sense is considered due to the fact that the water content of the layer is equilibrated in a short period of time when the layer is set, thus averaging the gelatin concentration.

In this invention, at least one of outermost layer and/or the layers coated simultaneously with the outermost layer should contain hardener (if the hardener is diffusible, when it is contained in a given layer of a plurality of layers to be coated simultaneously, the other layer or layers are also hardened).

As hardener, normally used one is applicable, such as aldehyde compounds, e.g., formaldehyde, glutaraldehyde; ketone compounds, e.g., diacetyl, cyclopentanediol, bis(2-chloroethyl urea)-2-hydroxy-4,6-dichloro-1,3,5-triazine; compounds having reactive halogen such as disclosed in U.S. Pat. No. 3,288,775, divinylsulphone compounds having reactive olefins in U.S. Pat. No. 3,635,718, N-methylol compounds in U.S. Pat. No. 2,732,316, isocyanates in U.S. Pat. No. 3,103,437, aziridine compounds in U.S. Pat. No. 3,017,280, and No. 2,983,611, carbodiimide compounds in U.S. Pat. No. 3,100,704, epoxy compounds in U.S. Pat. No. 3,091,537, halogen carboxyaldehydes such as mucochloric acid, dioxane derivatives such as dihydroxydioxane, inorganic hardeners such as chrome alum, potassium alum, zirconium sulfate, etc., one or two or more of which are used in combination.

The amount of the hardener to be used should be calculated to the whole gelatin in all the layers, which amount should be of minimum necessary to reach the required level of hardening, and may be varied at discretion according to purpose, preferably approximately 0.02–0.2 millimol.

In practicing the present invention, a surface active agent is advantageously used as coating aid prior to the coating, such as natural surface active agent such saponin, nonionic surface active agent such as alkylene oxides, glycerols, glycidols, higher alkylamines, quarternary ammonium salts, heterocyclic compounds such as pyridine or others, cationic surface active agent such as sulfoniums, anionic surface active agent such as cerbonic acid, sulfonic acid, phosphoric acid, sulfate radical, phosphate radical, etc., and amphoteric surface active agent such as amino acids, aminosulfonic acids, aminoalcohol sulfates, or phosphates, etc., one or two or more of which may be used in combination.

The silver halide emulsion used in the photographic light-sensitive material to which this invention is applied may be prepared in a known or conventional manner, and is not limited by a way of formation or dispersing, composition of silver halide (e.g., silver chloride, silver bromide, silver iodo-bromide, silver chloro-bromide, etc.), grain size or crystal habit of silver halide, the proportion of silver halide to gelatin, pH or pAg of silver halide emulsion, the kind and quantity of chemical sensitizers, the kind and quantity of optical sensitizers, couplers, high boiling point solvents, the kind and quantity of other additives, the kind and quantity of gelatin and other binders, etc.

For the support of the photographic light-sensitive material in this invention, any materials usually used may be unlimitedly employed, for example, baryta paper, paper laminated with polyolefin resin, cellulose acetate film polystyrene film, polyethylene terephthalate film, polycarbonate film, etc.

If the drying is performed in accordance with the method of this invention, not only is the objects of this invention accomplished but also the hardening of the photographic layers is advantageously progressed to reduce the period of time taken to reach the saturated hardness, thus being advantageous economically and for the process management. Subsequently, the after-hardening effect is also improved so that the variation of the hardness of the product in the market is reduced, contributing to the stability of the product quality. Further, the method of this invention enables the same amount of hardener to provide larger hardening effect than in the conventional way; that is, it makes possible to use the smaller amount of hardener to provide the same hardening effect. Accordingly, the consuming amount of hardener may be reduced, so that undesirable side reaction accompanying the addition of hardener may also be reduced.

The present invention is illustrated in further detail below with reference to examples.

EXAMPLE 1

As a coating liquid for a silver halide emulsion layer, 6% gelatin emulsion containing 40 g/100 $cm^2$ of silver bromide, and as a coating liquid for a protective layer to be superposedly coated on the emulsion layer, 6% aqueous solution of gelatin having the jelly strength of 240 g were prepared. In each of these liquids, a hardener, N,N',N''-trisacryloyl-1, 3, 5-S-triazine in an amount equivalent to 2 wt % to the gelatin and a surface active agent were incorporated. These coating liquids were superposedly coated simultaneously on a both-side-polyethylene-laminated paper treated thereon with electronic discharge, and thereafter was passed through the cooling zone for gelation, and then was dried under the conditions shown in table 1. The surface temperature at this time, the melting point of the outermost layer, and the turning point from the constant rate drying to the reduced rate drying are shown in table 1, corresponding to the gelatin concentrations of the coated layer.

In FIG. 1, while the abscissa indicates the variation of the gelatin concentrations due to the drying progress of the layer, the ordinate indicates the surface temperatures corresponding to the gelatin concentrations. The curves A, B, C, D, E, and F represent respectively the behaviors of the surface temperatures in the drying conditions A, B, C, D, E, and F in table 1. The curve G shows the melting points corresponding to the gelatin concentrations of the coated layer. In addition, the gelatin concentrations are divided by the boundary line at 17% into two zones A and B, the former being the constant rate drying zone, and the latter, the reduced rate drying zone.

TABLE 1

| Drying conditions | Constant rate drying zone DB/WB (°C.) | Reduced rate drying zone DB/WB (°C.) |
|---|---|---|
| A | 35.0/19.0 | 50/24.5 |
| B | 40.0/20.5 | 60/26.5 |
| C | 35.0/19.0 | 35.0/19.0 |
| D | 40.0/20.5 | 40.0/20.5 |
| E | 45.0/22.0 | 45.0/22.0 |
| F | 50.0/24.5 | 50.0/24.5 |

Note:
DB represents the dry-bulb temperature of the drying air.
WB represents the wet-bulb temperature of the same.

The curve for the melting points of the top layer in FIG. 1 were obtained by plotting after measuring the melting points of the gel produced by gelation of separately prepared liquids in accordance with the procedure specified in the Method of Measuring Melting Points of PAGI METHOD. The above-mentioned liquids were separately prepared so that each of the liquids is identical in composition with that of the coating liquid for the top layer but is different in the gelatin concentration by varying dilution ratio.

The time which was taken for the drying, gloss, and hardening were measured on the samples obtained after the progress and the drying process. The results obtained are shown in table 2. In addition, the time taken for the drying is the time from the beginning of the drying until when the water content of the layer reached about 10%. The hardening characteristics is expressed in terms of swelling rates on the samples taken after allowing them to stand for periods of three days and one week under the condition of 20° C. with 58% RH, and for three days under the condition of 50° C. with 80% RH. The swelling rates were obtained by measuring the samples immersed in a D-72 developing bath, the prescription by Eastman Kodak Company, kept at 20° C.

$$\text{Swelling rate} = \frac{\text{Weight of swelled layer} - \text{Weight of dried layer}}{\text{Weight of dried layer}} \times 100\ (\%)$$

The gloss was measured at incident light angle of 45° with the use of VG-1D type glossmeter, manufactured by the Nihon Denshiki Industry Co., Ltd., on the test samples developed for 90 seconds at 20° C. with D-72 developer solution, fixed, washed and dried at room temperature.

TABLE 2

| Drying conditions | Time taken for the drying (sec.) | Gloss (%) | Gloss (vis-ual) | Swelling rate (%) 20° C. 58% RH 3 days after | Swelling rate (%) 20° C. 58% RH 1 week after | Swelling rate (%) 50° C. 80% 3 days after | Gelatin concentration (%) at the turning point |
|---|---|---|---|---|---|---|---|
| A (this invention) | 185 | 53 | O | 235 | 205 | 198 | 17 |
| B (this invention) | 160 | 53 | O | 225 | 190 | 185 | 16 |
| C (control) | 225 | 55 | O | 270 | 240 | 225 | 16 |
| D (this invention) | 210 | 54 | O | 260 | 236 | 220 | 17 |
| E (this invention) | 205 | 22 | X | 250 | 225 | 205 | 16 |
| F (this invention) | 195 | 18 | X | 240 | 210 | 195 | 17 |

These results show that the drying performed in accordance with the method of the present invention is highly excellent in the drying time, gloss, and hardening characteristics as compared to that of the conventional processes.

EXAMPLE 2

Superposed, simultaneous coating of a protective layer coating liquid and a silver halide layer coating liquid on a support was performed in the same manner as in Example 1 with the exception that the gelatins shown in table 3 were used in place of the gelatin for the protective layer coating liquid in example 1. In example 2, however, a compound of the following formula was used as hardener in an amount equivalent to 2 wt. % of the gelatin used.

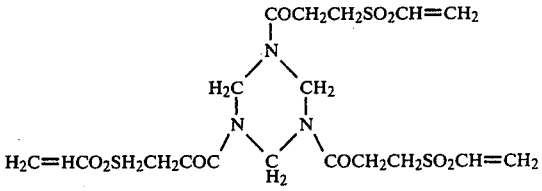

After cooling these samples for gelation, they were dried under the drying conditions A and B shown in table 1, and then were measured in the same manner as in Example 1 for the time taken for the drying, gloss, and hardening characteristics. The results obtained are shown in table 3.

TABLE 3

| Test sample No. | Gelatin: Raw material | Gelatin: Pre treatment | Gelatin: Jelly strength | Drying conditions A: Time taken for drying | Drying conditions A: Swelling rate (%) | Drying conditions A: Gloss (%) | Drying conditions A: Gloss (visual) | Drying conditions E: Time taken for drying | Drying conditions E: Swelling rate (%) | Drying conditions E: Gloss (%) | Drying conditions E: Gloss (visual) |
|---|---|---|---|---|---|---|---|---|---|---|---|
| 1 | Bone | | | | 250 | | | | 260 | | |

TABLE 3-continued

| Test sample No. | Gelatin: Raw material | Gelatin: Pre treatment | Gelatin: Jelly strength | Drying conditions A: Time taken for drying | Drying conditions A: Swelling rate (%) | Drying conditions A: Gloss (%) | Drying conditions A: Gloss (visual) | Drying conditions E: Time taken for drying | Drying conditions E: Swelling rate (%) | Drying conditions E: Gloss (%) | Drying conditions E: Gloss (visual) |
|---|---|---|---|---|---|---|---|---|---|---|---|
| | Ossein | Lime | 180 | 180 | 230 | 35 | X | 2115 | 245 | 20 | X |
| | | | | | 220 | | | | 235 | | |
| | | | | | 240 | | | | 253 | | |
| 2 | Bone | | | | 240 | | | | | 253 | |
| | Ossein | " | 210 | 180 | 220 | 51 | O | 210 | 235 | 28 | X |
| | | | | | 215 | | | | 225 | | |
| 3 | Bone | | | | 230 | | | | 245 | | |
| | Ossein | " | 270 | 185 | 210 | 55 | O | 210 | 225 | 35 | X |
| | | | | | 205 | | | | 215 | | |
| 4 | Bone | | | | 235 | | | | 245 | | |
| | Ossein | " | 300 | 185 | 215 | 60 | O | 220 | 42 | X | |
| | | | | | 208 | | | | 208 | | |

Note:
Swelling rate: In the same frame of this table,
top — 20° C. 58% RH 3 days after the drying.
middle — 20° C. 58% RH 1 week after the drying.
bottom — 50° C. 58% RH 3 days after the drying.

The results (table 3) show that under the conditions A, sample 1, the gelatin with the jelly strength of 180 g is poor, but samples 2, 3, and 4 are excellent in gloss characteristics. On the other hand, under the conditions E, all the gelatins are not good in gloss characteristics. As to hardening characteristics, under the conditions A, the temperatures in the constant rate drying zone are lower, while in the reduced rate drying zone, the temperatures are higher, thus giving satisfactory results.

EXAMPLE 3

Superposed coating samples were prepared in the same manner as in Example 1 with the exception of the use of compounds of the formulas (1), (2), and (3) as hardener, in an amount equivalent to 2 wt. % of the gelatin used, in place of the one in Example 1.

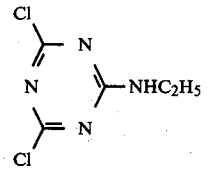

(1)

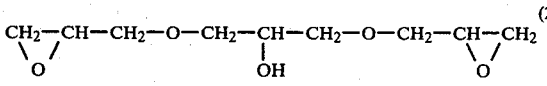

(2)

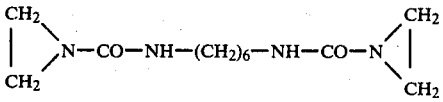

(3)

After cooling these samples for gelation, they were dried under the conditions A, C, and E shown in table 1. The time which was taken for the drying, gloss, and hardening characteristics obtained in the same manner as the procedure in Example 1 are shown in table 4.

TABLE 4

| Hardener | Drying conditions | Time taken for the drying (seconds) | Gloss (%) | Gloss (visual) | Swelling rate 20° C. 58% RH 3 days after | Swelling rate 20° C. 58% RH 1 week after | Swelling rate 50° C. 80% RH 3 days after |
|---|---|---|---|---|---|---|---|
| | A | 180 | 55 | O | 228 | 210 | 203 |
| (1) | C | 220 | 57 | O | 265 | 240 | 220 |
| | E | 200 | 26 | X | 255 | 235 | 215 |
| | A | 185 | 50 | O | 220 | 200 | 190 |
| (2) | C | 220 | 50 | O | 260 | 235 | 215 |
| | E | 205 | 21 | X | 252 | 230 | 208 |
| | A | 185 | 53 | O | 220 | 195 | 185 |
| (3) | C | 225 | 55 | O | 252 | 230 | 215 |
| | E | 205 | 24 | X | 245 | 225 | 203 |

From the results, it is found that any of the hardeners selected for the testing are satisfactory in the time taken for the drying, gloss, and hardening characteristics.

Figure 1:
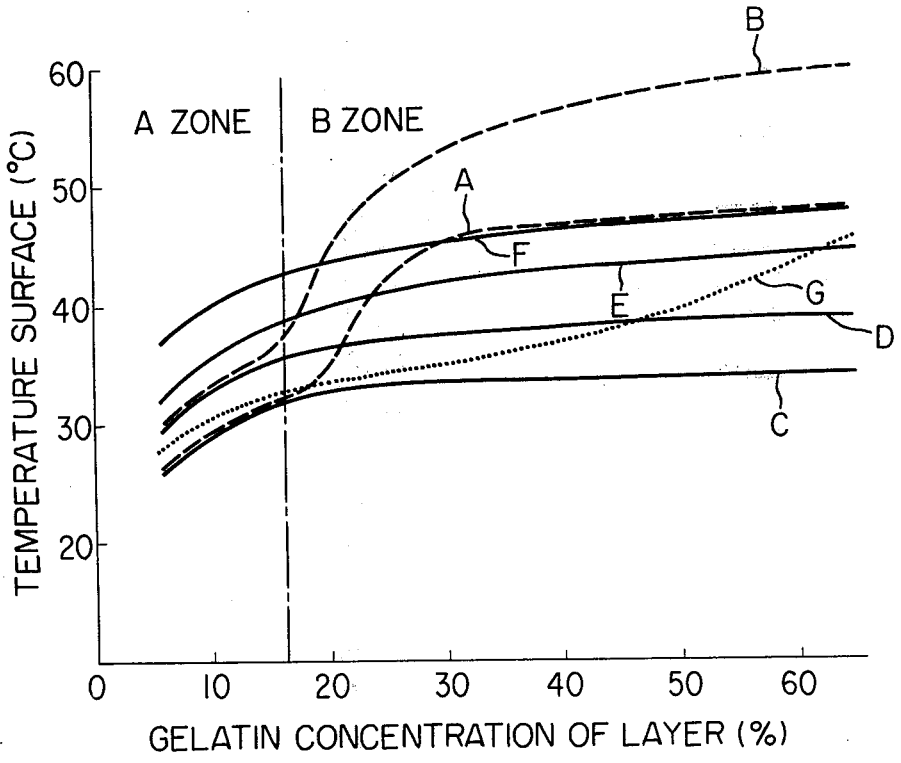
FIG. 1 is a graph showing the drying conditions in the embodiments of the present invention, according to Example 1.

What is claimed is:

1. In a method for the manufacturing of a silver halide photographic material having a layer containing gelatin coated on a support, the improvement which comprises drying the coated layer so that the surface temperature of the layer during the falling rate drying period is more than 5° C. above the melting point of the layer during drying and the jelly strength of said gelatin being at least 200 g according to the PAGI method.

2. A method according to claim 1 wherein the coated layer is dried so that the surface temperature of the layer in a constant rate drying period is lower than a temperature of 5 centigrade plus a melting point of the layer at a time of passage of drying.

3. A method according to claim 1 wherein the layer containing gelatin contains a hardener.

4. A method according to claim 1 wherein the surface temperature of the layer is higher than a temperature of 5–80 centigrade plus the melting point.

* * * * *